US006243674B1

(12) United States Patent
Yu

(10) Patent No.: US 6,243,674 B1
(45) **Date of Patent: *Jun. 5, 2001**

(54) ADAPTIVELY COMPRESSING SOUND WITH MULTIPLE CODEBOOKS

(75) Inventor: Alfred Yu, Irvine, CA (US)

(73) Assignee: American Online, Inc., Dulles, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/033,223

(22) Filed: Mar. 2, 1998

Related U.S. Application Data

(62) Division of application No. 08/545,487, filed on Oct. 20, 1995, now abandoned.

(51) Int. Cl.[7] ..... G10L 19/12

(52) U.S. Cl. ..... 704/221; 704/233; 704/242; 704/244; 704/245

(58) Field of Search ..... 704/205, 210, 704/216, 233, 230, 222, 207, 214, 242, 244, 245, 249, 236, 221

(56) References Cited

U.S. PATENT DOCUMENTS

| | | | | |
|---|---|---|---|---|
| 4,667,340 | * | 5/1987 | Arjmand et al. | 704/207 |
| 4,731,846 | * | 3/1988 | Secrest et al. | 704/207 |
| 4,868,867 | * | 9/1989 | Davidson et al. | 395/2.16 |
| 5,125,030 | * | 6/1992 | Nomura et al. | 395/2.31 |
| 5,127,053 | * | 6/1992 | Koch | 381/31 |
| 5,199,076 | * | 3/1993 | Taniguchi et al. | 395/2.31 |
| 5,206,884 | * | 4/1993 | Bhaskar | 375/254 |
| 5,245,662 | * | 9/1993 | Taniguchi et al. | 395/2.31 |
| 5,265,190 | * | 11/1993 | Yip et al. | 704/219 |
| 5,323,486 | * | 6/1994 | Taniguchi et al. | 395/2.31 |
| 5,371,853 | * | 12/1994 | Kao et al. | 395/2.32 |
| 5,513,297 | * | 4/1996 | Kleijn et al. | 395/2.32 |
| 5,577,159 | * | 11/1996 | Shoham | 395/2.15 |
| 5,699,477 | * | 12/1997 | McCree | 395/2.25 |
| 5,706,395 | * | 1/1998 | Arslan et al. | 395/2.35 |
| 5,734,789 | * | 3/1998 | Swaminathan et al. | 395/2.15 |
| 5,751,903 | * | 5/1998 | Swaminathan et al. | 395/2.39 |
| 5,819,212 | * | 10/1998 | Matsumoto et al. | 704/219 |
| 5,857,167 | * | 1/1999 | Gritton et al. | 704/223 |

FOREIGN PATENT DOCUMENTS

| | | | | |
|---|---|---|---|---|
| 05232994 | * | 10/1993 | (JP) | G10L/9/14 |
| WO 93 05502 | * | 3/1993 | (WO) | G10L/5/00 |

OTHER PUBLICATIONS

Shoham, Y., ("Cascaded likelihood vector coding of the LPC information", Acoustics, Speech, and Signal Processing, 1989, ICASSP'89, Vol. 1, pp. 160–163), Jan. 1989.*

(List continued on next page.)

*Primary Examiner*—David R. Hudspeth
*Assistant Examiner*—Vijay B. Chawan
(74) *Attorney, Agent, or Firm*—Fish & Richardson, PC

(57) ABSTRACT

A sound compression system adaptively switches codebooks in and out based on a calculation carried out with the output of the codebook. The system uses three separate codebooks: adaptive vector quantization codebook, real pitch codebook, and noise codebook. The perceptually-weighted filter is generated adaptively using the predictive coefficients from the current sub-frame.

7 Claims, 1 Drawing Sheet

OTHER PUBLICATIONS

Chan et al., ("Automatic target recognition using modularly cascaded vector quantizers and multilayer perceptrons", Acoustics, Speech, and Signal Processing, 1996, ICASSP''96, Vol. 6, pp. 3386–3389), Jan. 1996.*

Bhattacharya et al., ("Tree–searched multi–stage vector quantization of LPC parameters for 4Kb/s speech coding", Acoustics, Speech, and Signal Processing, 1992, ICASSP'92, Vol. 1, pp. 105–108), Jan. 1992.*

Gersho and Gray, ("constrained Vector Quantization", Chapter 12, Vector Quantization and Signal Compression, Kluwer Academic Publishers, Norwell, MA, pp. 407–487, 1992), Jan. 1992.*

* cited by examiner

ADAPTIVELY COMPRESSING SOUND WITH MULTIPLE CODEBOOKS

This application is a division of Ser. No. 08/545,487 filed Oct. 20, 1995 now abandoned.

FIELD OF THE INVENTION

The present invention teaches a system for compressing quasi-periodic sound by comparing it to presampled portions in a codebook.

BACKGROUND AND SUMMARY

Many sound compression schemes take advantage of the repetitive nature of everyday sounds. For example, the standard human voice coding device or "vocoder", is often used for compressing and encoding human voice sounds. A vocoder is a class of voice coder/decoders that models the human vocal tract.

A typical vocoder models the input sound as two parts: the voice sound known as V, and the unvoice sound known as U. The channel through which these signals are conducted is modelled as a lossless cylinder. The output speech is compressed based on this model.

Strictly speaking, speech is not periodic. However, the voice part of speech is often labeled as quasi-periodic due to its pitch frequency. The sounds produced during the un-voiced region, are highly random. Speech is always referred to as non-stationary and stochastic. Certain parts of speech may have redundancy and perhaps correlated to some prior portion of speech to some extent, but they are not simply repeated.

The main intent of using a vocoder is to find ways to compress the source, as opposed to performing compression of the result. The source in this case is the excitation formed by glottal pulses. The result is the human speech we hear. However, there are many ways that the human vocal tract can modulate the glottal pulses to form human voice. Estimations of the glottal pulses are predicted and then coded. Such a model reduces the dynamic range of the resulting speech, hence rendering the speech more compressible.

More generally, the special kind of speech filtering can remove speech portions that are not perceived by the human ear. With the vocoder model in place, a residue portion of the speech can be made compressible due to its lower dynamic range.

The term "residue" has multiple meanings. It generally refers to the output of the analysis filter, the inverse of the synthesis filter which models the vocal tract. In the present situation, residue takes on multiple meanings at different stages: at stage 1—after the inverse filter (all zero filter), stage 2: after the long term pitch predictor or the so-called adaptive pitch VQ, stage 3: after the pitch codebook, and at stage 4: after the noise codebook. The term "residue" as used herein literally refers to the remaining portion of the speech by-product which results from previous processing stages.

The preprocessed speech is then encoded. A typical vocoder uses an 8 kHz sampling rate at 16 bits per sample. These numbers are nothing magic, however—they are based on the bandwidth of telephone lines.

The sampled information is further processed by a speech codec which outputs an 8 kHz signal. That signal may be post-processed, which may be the opposite of the input processing. Other further processing that is designed to further enhance the quality and character of the signal may be used.

The suppression of noise also models the way that humans perceives sound. Different weights are used at different times according to the strength of speech both in the frequency and time domain. The masking properties of human hearing cause loud signals at different frequencies to mask the effect of low level signals around those frequencies. This is also true in the time domain. The result is that more noise can be tolerated during that portion of time and frequency. This allows us to pay more attention elsewhere. This is called "perceptual weighting"—it allows us to pick vectors which are perpectually more effective.

The human vocal tract can be (and is) modeled by a set of lossless cylinders with varying diameters. Typically, it is modeled by an 8 to 12th order all-pole filter 1/A(Z). Its inverse counterpart A(Z) is an all-zero filter with the same order. Output speech is reproduced by exciting the synthesis filter 1/A(z) with the excitation. The excitation, or glottal pulses is estimated by inverse filtering the speech signal with the inverse filter A(z). A digital signal processor often models the synthesis filter as the transfer function H(V) =1/A(z). This means that this model is an all-pole process. Ideally, the model is more complicated, and includes both poles and zeros.

Much of the compressibility of speech comes from its quasi-periodicity. Speech is quasi-periodic due to its pitch frequency around voice sound. Male speech usually has a pitch between 50 and 100 Hz. Female speech usually has a pitch above 100 Hz.

While the above describes compression systems for voice coding, the same general principles are used to code and compress other similar kinds of sound.

Various techniques are known for improving the model. Each of these techniques, however, increases the necessary bandwidth to carry the signal. This produces a tradeoff between bandwidth of the compressed signal and quality of the non-steady-state sound.

These problems are overcome according to the present invention by new features.

A first aspect of the present invention includes a new architecture for coding which allows various coding and monitoring advantages. The disclosed system of the present invention includes new kinds of codebooks for coding. These new codebooks allow faster consequence to changes in the input sound stream. Essentially, these new codebooks use the same software routine many times over, to improve coding efficiency.

BRIEF DESCRIPTION OF THE DRAWINGS

These and other aspects of the present invention will now be described with reference to the accompanying drawings in which.

DESCRIPTION OF THE PREFERRED EMBODIMENTS

Figure 1:
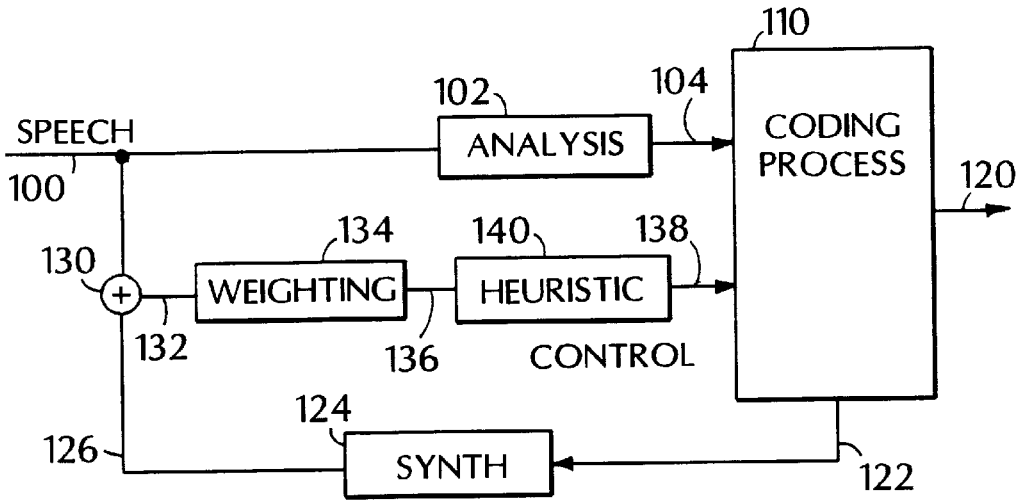
FIG. 1 shows a block diagram of the basic vocoder of the present invention.

FIG. 1 shows the advanced vocoder of the present invention. The current speech codec uses a special class of vocoder which operates based on LPC (linear predictive coding). All future samples are being predicted by a linear combination of previous samples and the difference between predicted samples and actual samples. As described above, this is modeled after a lossless tube also known as an all-pole model. The model presents a relative reasonable short term prediction of speech.

The above diagram depicts such a model, where the input to the lossless tube is defined as an excitation which is further modeled as a combination of periodic pulses and random noise.

A drawback of the above model is that the vocal tract does not behave exactly as a cylinder and is not lossless. The human vocal tract also ha side passages such as the nose.

Speech to be coded 100 is input to an analysis block 102 which analyzes the content of the speech as described herein. The analysis block produces a short term residual alone with other parameters.

Analysis in this case refers as LPC analysis as depicted above in our lossless tube model, that includes, for example, computation of windowing, autocorrelation, Durbin's recursion, and computation of predictive coefficients are performed. In addition, filtering incoming speech with the analysis filter based on the computed predictive coefficients will generate the residue, the short term residue STA_res 104.

This short term residual 104 is further coded by the coding process 110, to output codes or symbols 120 indicative of the compressed speech. Coding of this preferred embodiment involves performing three codebook searches, to minimize the perceptually-weighted error signal. This process is done in a cascaded manner such that codebook searches are done one after another.

The current codebooks used are all shape gain VQ codebooks. The perceptually-weighted filter is generated adaptively using the predictive coefficients from the current sub-frame. The filter input is the difference between the residue from previous stage versus the shape gain vector from the current stage, also called the residue, is used for next stage. The output of this filter is the perceptually weighted error signal. This operation is shown and explained in more detail with reference to FIG. 2. Perceptually-weighted error from each stage is used as a target for the searching in next stage.

The compressed speech or a sample thereof 122 is also fed back to a synthesizer 124, which reconstitutes a reconstituted original block 126. The synthesis stage decodes the linear combination of the vectors to form a reconstruction residue, the result is used to initialize the state of the next search in next sub-frame.

Comparison of the original versus the reconstructed sound results in an error signal which will drive subsequent codebook searches to further minimize such perceptually-weighted error. The objective of the subsequent coder is to code this residue very efficiently.

The reconstituted block 126 indicates what would be received at the receiving end. The difference between the input speech 100 and the reconstituted speech 126 hence represents an error signal 132.

This error signal is perceptually weighted by weighting block 134. The perceptual weighting according to the present invention weights the signal using a model of what would be heard by the human ear. The perceptually-weighted signal 136 is then heuristically processed by heuristic processor 140 as described herein. Heuristic searching techniques are used which take advantage of the fact that some codebooks searches are unnecessary and as a result can be eliminated. The eliminated codebooks are typically codebooks down the search chain. The unique process of dynamically and adaptively performing such elimination is described herein.

The selection criterion chosen is primarily based on the correlation between the residue from a prior stage versus that of the current one. If they are correlated very well, that means the shape-gain VQ contributes very little to the process and hence can be eliminated. On the other hand, if it does not correlate very well the contribution from the codebook is important hence the index shall be kept and used.

Other techniques such as stopping the search when an adaptively predetermined error threshold has been reached, and asymptotic searches are means of speeding up the search process and settling with a sub-optimal result. The heuristically-processed signal 138 is used as a control for the coding process 110 to further improve the coding technique.

This general kind of filtering processing is well known in the art, and it should be understood that the present invention includes improvements on the well known filtering systems in the art.

Figure 2:
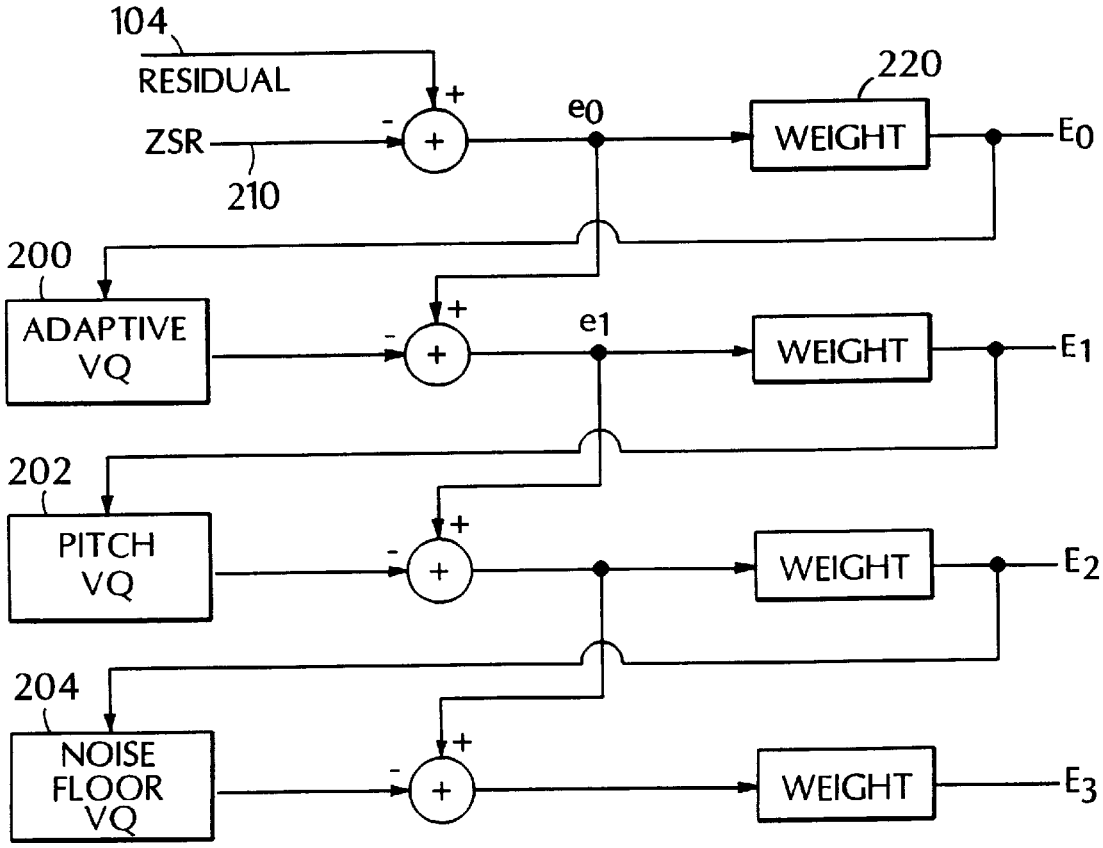
FIG. 2 the advanced codebook technique of the present invention.

The coding according to the present invention uses the codebook types and architecture shown in FIG. 2. This coding includes three separate codebooks: adaptive vector quantatization (VQ) codebook 200, real pitch codebook 202, and noise codebook 204. The new information, or residual 104, is used as a residual to subtract from the code vector of the subsequent block. ZSR (Zero state response) is a response with zero input. The ZSR is a response produced when the code vector is all zeros. Since the speech filter and other associated filters are IIR (infinite impulse response) filters, even when there is no input, the system will still generate output continuously. Thus, a reasonable first step for codebook searching is to determine whether it is necessary to perform any more searches, or perhaps no code vector is needed for this subframe.

To clarify this point, any prior event will have a residual effect. Although that effect will diminish as time passes, the effect is still present well into the next adjacent sub-frames or even frames. Therefore, the speech model must take these into consideration. If the speech signal present in the current frame is just a residual effect from a previous frame, then the perceptually-weighted error signal $E_0$ will be very low or even be zero. Note that, because of noise or other system issues, all-zero error conditions will almost never occur.

$e_0$ =STA_res−$\phi$. The reason $\phi$ vector is used is for completeness to indicate zero state response. This is a set-up condition for searches to be taken place. If E$\phi$ is zero, or approaches zero, then no new vectors are necessary.

E0 is used to drive the next stage as the "target" of matching for the next stage. The objective is to find a vector such that E1 is very close to or equal to zero, where E1 is the perceptually weighted error from e1, and e1 is the difference between e0-vector(i). This process goes on and on through the various stages.

The preferred mode of the present invention uses a preferred system with 240 samples per frame. There are four subframes per frame, meaning that each subframe has 60 samples.

A VQ search for each subframe is done. This VQ search involves matching the 60-part vector with vectors in a codebook using a conventional vector matching system.

Each of these vectors must be defined according to an equation. The basic equation used is of the form that $G_aA_i+G_bB_j+G_cC_k$.

Since the objective is to come up with a minimum perceptually weighted error signal E3 by selecting vectors Ai, Bj, and Ck along with the corresponding gain Ga, Gb, and Gc. This does NOT imply the vector sum of $$G_a{}^*A_i+G_bB_j+G_CC_E=STA_res.$$

In fact, it is almost never true with the exception of silence.

The error value $E_0$ is preferably matched to the values in the AVQ codebook 200. This is a conventional kind of codebook where samples of previous reconstructed speech, e.g., the last 20 ms, is stored. A closest match is found. The value $e_1$ (error signal number 1) represents the leftover between the matching of $E_0$ with AVQ 200.

According to the present invention, the adaptive vector quantizer stores a 20 ms history of the reconstructed speech. This history is mostly for pitch prediction during voice frame. The pitch of a sound signal does not change quickly. The new signal will be closer to those values in the AVQ than they will to other things. Therefore, a close match is usually expected.

Changes in voice, however, or new users entering a conversation, will degrade the quality of the matching. According to the present invention, this degraded matching is compensated using other codebooks.

The second codebook used according to the present invention is a real pitch codebook 202. This real pitch codebook includes code entries for the most usual pitches. The new pitches represent most possible pitches of human voices, preferably from 200 Hz down. The purpose of this second codebook is to match to a new speaker and for startup/voice attack purposes. The pitch codebook is intended for fast attack when voice starts or when a new person entering the room with new pitch information not found in the adaptive codebook or the so-called history codebook. Such a fast attack method allows the shape of speech to converge more quickly and allows matches more closely to that of the original waveform during the voice region.

Usually when a new speaker enters the sound field, AVQ will have a hard time performing the matching. Hence, E1 is still very high. During this initial time, therefore, there are large residuals, because the matching in the codebook is very poor. The residual $E_1$ represents the new speaker's pitch weighted error. This residual is matched to the pitch in the real pitch codebook 202.

The conventional method uses some form of random pulse codebook which is slowly shaped via the adaptive process in 200 to match that of the original speech. This method takes too long to converge. Typically it takes about 6 sub-frames and causes major distortion around the voice attack region and hence suffers quality loss.

The inventors have found that this matching to the pitch codebook 202 causes an almost immediate re-locking of the signal. For example, the signal might be re-locked in a single period, where one sub-frame period=60 samples=60/8000=7.5 ms. This allows accurate representation of the new voice during the transitional period in the early part of the time while the new speaker is talking.

The noise codebook 204 is used to pick up the slack and also help shape speech during the unvoiced period.

As described above, the G's represent amplitude adjustment characteristics, and A, B and C are vectors.

The codebook for the AVQ preferably includes 256 entries. The codebooks for the pitch and noise each include 512 entries.

The system of the present invention uses three codebooks. However, it should be understood that either the real pitch codebook or the noise codebook could be used without the other.

Additional processing is carried out according to the present invention under the characteristic called heuristics. As described above, the three-part codebook of the present invention improves the efficiency of matching. However, this of course is only done at the expense of more transmitted information and hence less compression efficiency. Moreover, the advantageous architecture of the present invention allows viewing and processing each of the error values $e_0$–$e_3$ and $E_0$–$E_3$. These error values tell us various things about the signals, including the degree of matching. For example, the error value $E_0$ being 0 tells us that no additional processing is necessary. Similar information can be obtained from errors $E_0$–$E_3$. According to the present invention, the system determines the degree of mismatching to the codebook, to obtain an indication of whether the real pitch and noise codebooks are necessary. Real pitch and noise codebooks are not always used. These codebooks are only used when some new kind or character of sound enters the field.

The codebooks are adaptively switched in and out based on a calculation carried out with the output of the codebook.

The preferred technique compares $E_0$ to $E_1$. Since the values are vectors, the comparison requires correlating the two vectors. Correlating two vectors ascertains the degree of closeness therebetween. The result of the correlation is a scalar value that indicates how good the match is. If the correlation value is low, it indicates that these vectors are very different. This implies the contribution from this codebook is significant, therefore, no additional codebook searching steps are necessary on the contrary, if the correlation value is high, the contribution from this codebook is not needed, then further processings are required. Accordingly, this aspect of the invention compares the two error values to determine if additional codebook compensation is necessary. If not, the additional codebook compensation is turned off to increase the compression.

A similar operation can be carried out between $E_1$ and $E_2$ to determine if the noise codebook is necessary.

Moreover, those having ordinary skill in the art will understand that this can be modified other ways using the general technique that a determination of whether the coding is sufficient is obtained, and the codebooks are adaptively switched in or out to further improve the compression rate and/or matching.

Additional heuristics are also used according to the present invention to speed up the search. Additional heuristics to speed up codebook searches are:

a) a subset of codebooks is searched and a partial perceptually weighted error Ex is determined. If Ex is within a certain predetermined threshold, matching is stopped and decided to be good enough. Otherwise we search through the end. Partial selection can be done randomly, or through decimated sets.

b) An asymptotic way of computing the perceptually weighted error is used whereby computation is simplified.

c) Totally skip the perceptually weighted error criteria and minimize "e" instead. In such case, an early-out algorithm is available to further speed up the computation.

Another heuristic is the voice or unvoice detection and its appropriate processing. The voice/unvoice can be determined during preprocessing. Detection is done, for example, based on zero crossings and energy determinations. The processing of these sounds is done differently depending on whether the input sound is voice or unvoice. For example, codebooks can be switched in depending on which codebook is effective.

Different codebooks can be used for different purposes, including but not limited to the well known technique of shape gain vector quantatization and join optimization. An increase in the overall compression rate is obtainable based on preprocessing and switching in and out the codebooks.

Although only a few embodiments have been described in detail above, those having ordinary skill in the art will certainly understand that many modifications are possible in the preferred embodiment without departing from the teachings thereof.

All such modifications are intended to be encompassed within the following claims.

What is claimed is:

1. A sound compression system, comprising:

a sound input mechanism, configured to receive sound to be compressed;

a plurality of codebooks, each of said plurality of codebooks connected to receive a sample indicative of said sound to be compressed, said plurality of codebooks being used to compress said sample to form a compressed result by processing said sample using information in the codebooks;

a residue determining device, calculating an error signal indicating a difference between said compressed result and said sample; and a heuristic coding selection element, which determines which of said plurality of codebooks to use based on said error signal obtained from using said each of said codebooks, said heuristic coding selection element allowing said sound compressing to be carried out with less than all of said codebooks or with all of said codebooks.

2. A system as in claim 1, wherein said plurality of codebooks include a first codebook which compares said sample with other recent samples using information in said first codebook.

3. A system as in claim 2, wherein said plurality of codebooks further includes a second codebook which compares said sample with a sample of pitches indicating statistically likely pitches of said sound stored in said second codebook.

4. An apparatus operating to code input sound, comprising:

a first codebook, which compares said input sound with other input sounds which have been inputted a short time before said input sound and produces an output indicative thereof; and a second codebook which compares said input sound with other input sounds which have not been recently inputted only when said output indicates an error between said input sound and said other input sounds, when error is greater than a threshold, said second codebook includes statistically likely pitches of said input sound, wherein said second codebook provides a fast attack in tracking changes in the input sound by allowing shaping of said input sound to converge more quickly.

5. An apparatus as in claim 4 further comprising a third codebook operating to compare said input sounds with noise floors indicative of silence, said third codebook configured to help second codebook in shaping said input sound during an unvoiced period.

6. A method of coding sound, comprising:

processing input sound according to different criteria stored in a plurality of codebooks said plurality of codebooks producing outputs indicative thereof;

evaluating said outputs to determine which of said codebooks most effectively compresses said sound; and using only those codebooks which effectively compress said sound.

7. A method as in claim 6 wherein one of said plurality of codebooks is a codebook for comparing input sounds with recently input sounds and another of said plurality of codebooks is a codebook for comparing input sounds with samples of likely sounds that will be input.

* * * * *

UNITED STATES PATENT AND TRADEMARK OFFICE

CERTIFICATE OF CORRECTION

PATENT NO. : 6,243,674 B1
DATED : June 5, 2001
INVENTOR(S) : Alfred Yu

It is certified that error appears in the above-identified patent and that said Letters Patent is hereby corrected as shown below:

Title page,
Item [73] Assignee, please change "American Online, Inc." to -- American Online, Inc. --

Signed and Sealed this

Twenty-eighth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,243,674 B1
DATED : June 5, 2001
INVENTOR(S) : Alfred Yu

It is certified that error appears in the above-identified patent and that said Letters Patent is hereby corrected as shown below:

Title page,
Item [73], Assignee, please change "American Online, Inc." to
-- America Online, Inc. --

Signed and Sealed this

Sixth Day of August, 2002

*Attest:*

*Attesting Officer*

JAMES E. ROGAN
*Director of the United States Patent and Trademark Office*